US009457456B2

(12) United States Patent
Chen

(10) Patent No.: US 9,457,456 B2
(45) Date of Patent: Oct. 4, 2016

(54) REVERSIBLE RATCHET WRENCH

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 225 days.

(21) Appl. No.: 14/217,483

(22) Filed: Mar. 18, 2014

(65) Prior Publication Data

US 2014/0196577 A1 Jul. 17, 2014

Related U.S. Application Data

(63) Continuation-in-part of application No. 13/326,348, filed on Dec. 15, 2011, now abandoned.

(51) Int. Cl.
*B25B 13/46* (2006.01)
*B25B 13/04* (2006.01)

(52) U.S. Cl.
CPC ..... *B25B 13/463* (2013.01); *B25B 13/04* (2013.01)

(58) Field of Classification Search
CPC ..... B25B 13/04; B25B 13/46; B25B 13/463
USPC ..... 81/60–63.1; 192/43.1, 43.2
See application file for complete search history.

(56) References Cited

U.S. PATENT DOCUMENTS

| | | | | |
|---|---|---|---|---|
| 3,436,992 | A * | 4/1969 | Over | B25B 13/463 81/63.1 |
| 4,862,775 | A * | 9/1989 | Chow | B25B 13/463 192/43.1 |
| 7,062,994 | B2 * | 6/2006 | Chen | B25B 13/463 81/62 |
| 7,096,763 | B1 * | 8/2006 | Hsieh | B25B 13/463 81/60 |
| 7,299,720 | B1 * | 11/2007 | Schultz | B25B 13/463 81/62 |
| 7,802,498 | B2 * | 9/2010 | Hu | B25B 13/463 81/63.1 |
| 8,499,666 | B2 * | 8/2013 | Hopper | B25B 13/463 81/63.1 |
| 2009/0314139 | A1 * | 12/2009 | Hu | B25B 13/468 81/63.1 |

* cited by examiner

*Primary Examiner* — Hadi Shakeri
(74) *Attorney, Agent, or Firm* — Guice Patents PLLC

(57) ABSTRACT

A ratchet wrench includes a wrench body and a ratchet assembly disposed in the wrench body. The ratchet assembly includes a ratchet wheel, a Y-shaped bar, two pawls, a pawl spring and a switch member. The Y-shaped bar has a pair of prongs splayed laterally apart. Each of the pawls is engageable with the ratchet wheel and defines a bore in a lower corner thereof for reception of the respective prong of the Y-shaped bar. The pawl spring is disposed between the pawls. The switch member is partly positioned on an exterior of the wrench body, and operable to drive the Y-shaped bar to direct either one of the pawls to engage with the ratchet wheel.

3 Claims, 5 Drawing Sheets

REVERSIBLE RATCHET WRENCH

CROSS REFERENCE TO RELATED APPLICATIONS

This application is a continuation-in-part of U.S. Patent Pub. No. 2013/0152742, filed Dec. 15, 2011.

BACKGROUND OF THE INVENTION

1. Field of the Invention

The present invention relates to a ratchet wrench, more particularly to a reversible ratchet wrench, in which the cost to produce the same is relatively lower than the cost of the conventional ratchet wrench.

2. Description of Related Art

A conventional wrench is used to attach or to detach bolts and nuts from an article. The conventional wrench has an adjustable jaw for matching to the size of bolt and nut. In this way, the jaw can engage with the bolt and nut for a user to attach or detach. However, when the user operates the conventional wrench to attach or to detach the bolt and nut, the conventional wrench is needed to separate from the bolt and nut for repositioning after each screwing or rotating. It is inconvenient for the user.

In order to overcome the above shortcoming, some manufacturer combines a ratchet wheel into the wrench. The improved ratchet wrench comprises a wrench body, a ratchet wheel, a switch button and a device for adjusting the operative direction. The wrench body has a receiving room defined as a head portion. A switch room is defined near the receiving room. A control room is communicated with the switch room. The ratchet wheel is placed into the receiving room. The switch button is placed into the switch room. The switch button is engaged with the ratchet wheel. The device for adjusting the operative direction is placed into the control room. The switch button has a vertical hole defined at the bottom and a slot defined laterally. The slot is near the vertical hole. The device for adjusting the operative direction includes a block, an elastic member assembled on the block, and a control plate. One end of the elastic member is received into the vertical hole of the switch button for pushing the switch button to engage with the ratchet wheel. One end of the control plate is received into the slot of the switch button for preventing the elastic member from drop.

Unfortunately, the improved ratchet wrench has a precise structure so that the cost to produce the ratchet wrench is expensive. For example, if the teeth of the ratchet wheel are too sharp, the switch button is easy to engage with the ratchet wheel but difficult to disengage. In addition, the space of the switch room must match to the switch button, otherwise the gap between the switch button and the ratchet wheel might cause the ratchet wrench not to work. Thus, to produce a pair of useful switch button and ratchet wheel often costs a lot of time and money. How to improve the construction of the switch button and the ratchet wheel becomes an important issue in this field.

The present invention has arisen to mitigate and/or obviate the disadvantages of the conventional.

SUMMARY OF THE INVENTION

It is an objective of the present invention is to provide an improved reversible ratchet wrench.

To achieve the objective, the ratchet wrench comprises a wrench body and a ratchet assembly disposed in the wrench body. Specifically, the ratchet assembly includes a ratchet wheel, a Y-shaped bar, a first pawl, a second pawl, a pawl spring, and a switch member. The Y-shaped bar is formed with a stem, a first prong and a second prong extending from the stem. The first prong is tilted to the left, and the second prong is tilted to the right. The first pawl is engageable with the ratchet wheel and defines a first bore in a lower right corner thereof. The first bore is tilted to the left for reception of the first prong of the Y-shaped bar. Similarly, the second pawl is engageable with the ratchet wheel and defines a second bore in a lower left corner thereof. The second bore is tilted to the right for reception of the second prong of the Y-shaped bar. The pawl spring is disposed between the first and second pawls. The switch member is partly positioned on an exterior of the wrench body, and operable to drive the Y-shaped bar to move between a first position and a second position. When the Y-shaped bar is driven to the first position, the first pawl is moved to the left into engagement with the ratchet wheel by means of the first prong. When the Y-shaped bar is driven to the second position, the second pawl is moved to the right into engagement with the ratchet wheel by means of the second prong. In other words, the switch member is operable to control the ratcheting direction of the ratchet wrench.

Further benefits and advantages of the present invention will become apparent after a careful reading of the detailed description with appropriate reference to the accompanying drawings.

DETAILED DESCRIPTION OF THE INVENTION

Figure 1:
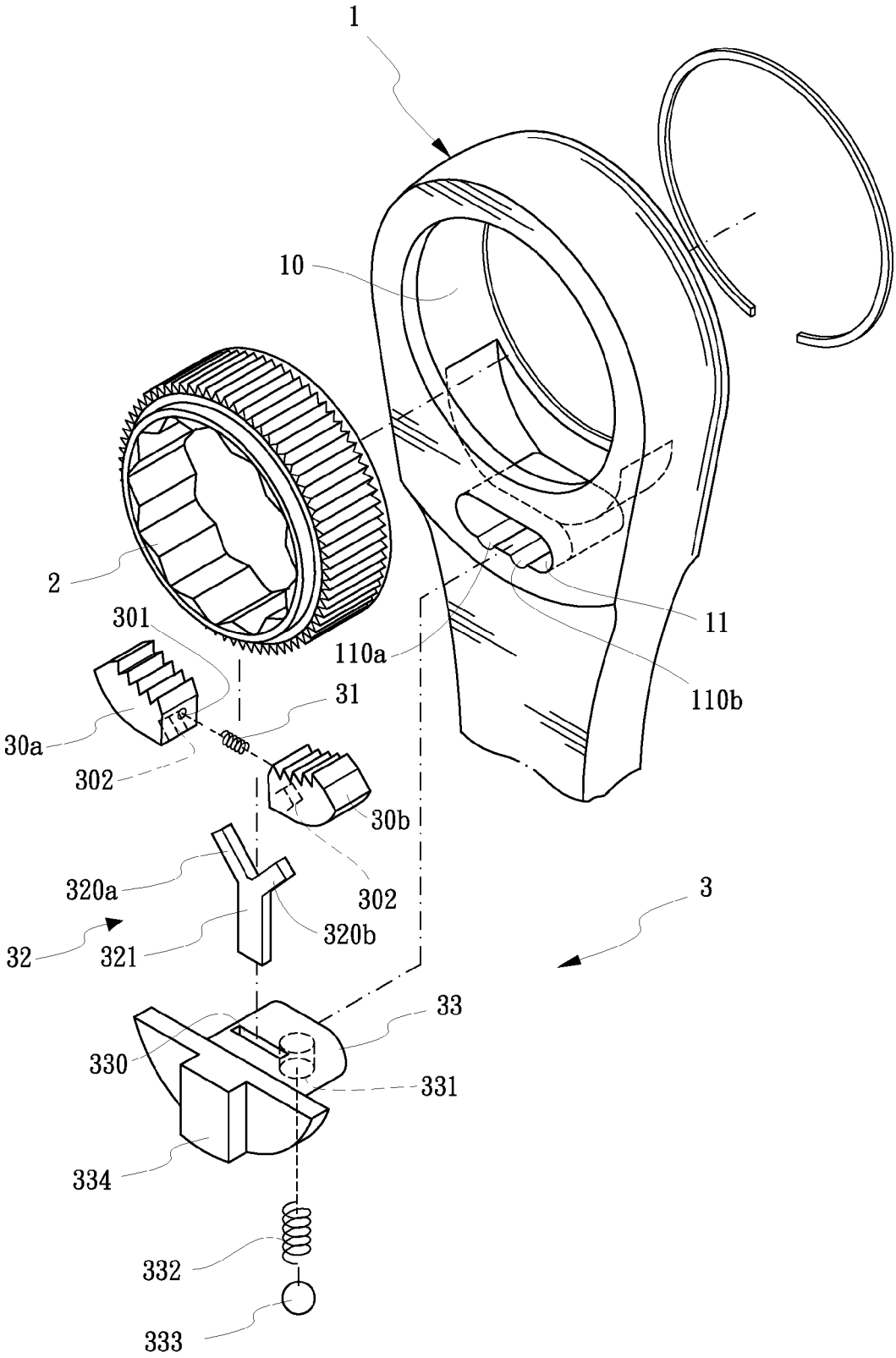
FIG. 1 is an exploded perspective view of a ratchet wrench in accordance with the present invention.
Figure 2:
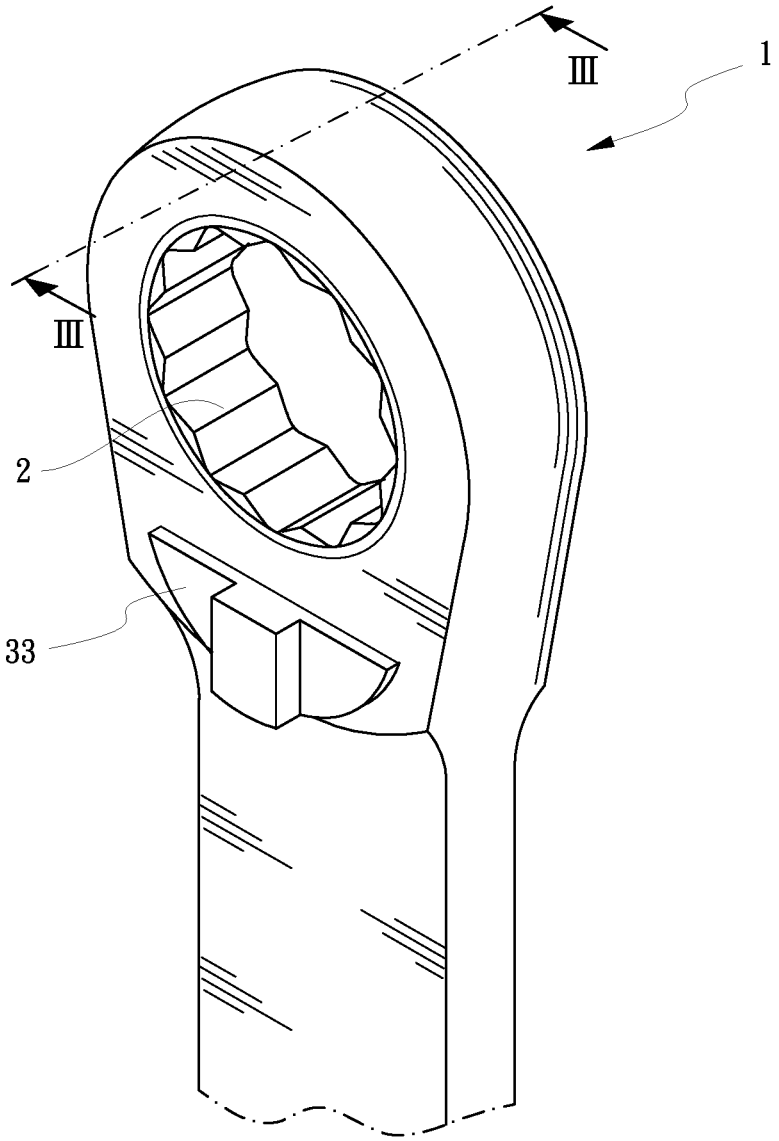
FIG. 2 is a perspective view of the ratchet wrench of FIG. 1.
Figure 3:
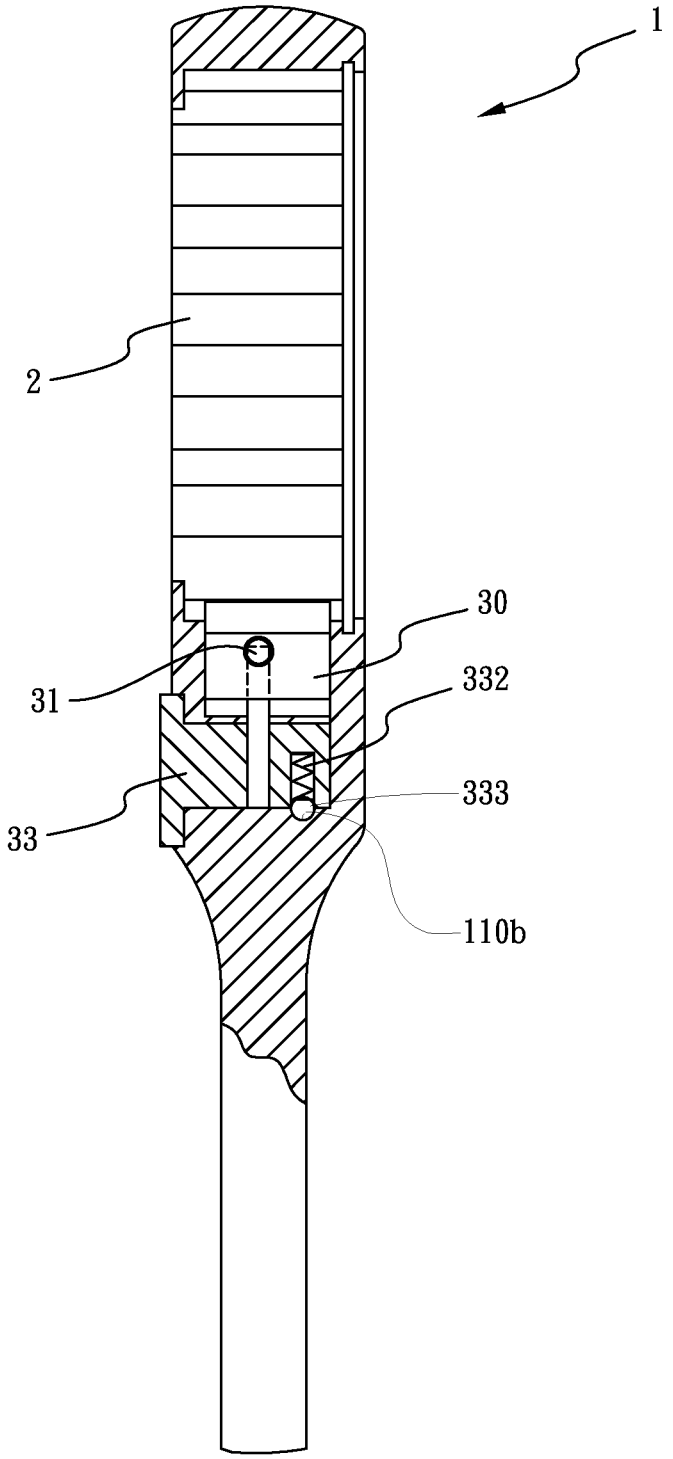
FIG. 3 is a cross-sectional view of the ratchet wrench along the line in FIG. 2.

Referring to the FIGS. 1-3, a ratchet wrench in accordance with the present invention comprises a wrench body 1, a ratchet wheel 2 and a reverse mechanism 3 having a pair of pawls 30*a*, 30*b*, a pawl spring 31 disposed between the pawls 30*a*, 30*b*, a Y-shaped bar 32 and a switch member 33 operable to control the ratchet direction.

The wrench body 1 has a receiving room 10 defined therein. A switch room 11 is defined below the receiving room 10 and communicated with the receiving room 10. The switch room 11 has an opening defined at the front side of the wrench body 1. Two horizontal grooves 110*a*, 110*b* are defined in the bottom of the switch room 11 at left and right side respectively.

The ratchet wheel 2 is assembled in the receiving room 10. A part of the ratchet wheel 2 is exposed in the switch room 11. The reverse mechanism 3 is assembled in the switch room 11.

Each of the pawls 30*a*, 30*b* is respectively engaged with the ratchet wheel 2. Preferably, each of the pawls 30*a*, 30*b* has a generally curved shape to correspond to a curvature of the ratchet wheel 2 for engagement with the ratchet wheel 2. Moreover, each of the pawls 30*a*, 30*b* has a lateral hole 301 respectively. The two lateral holes 301 are confronted with each other. The pawl spring 31 is biased and received in between the two lateral holes 301 of the two pawls 30*a*, 30*b*, and therefore the pawls 30*a*, 30*b* are elastically connected by the pawl spring 31.

The Y-shaped bar 32 has a stem 321 and two prongs 320*a*, 320*b* which extends from one end of the stem 321 and are splayed laterally apart. Each of the pawls 30*a*, 30*b* has a hole 302 defined in a lower corner thereof for engaging with the respective prong 320*a* or 320*b*. The bore 302 in the pawl 32*a* has a diameter slightly greater than that of the prong 320*a* of the Y-shaped bar 32. Similarly, the bore 302 in the pawl 32*b* has a diameter slightly greater than that of the prong 320*b* of the Y-shaped bar 32. The stem 321 of the Y-shaped bar 32 is inserted in a positioning slot 330 which is defined in the top of the switch member 33.

Figure 4:
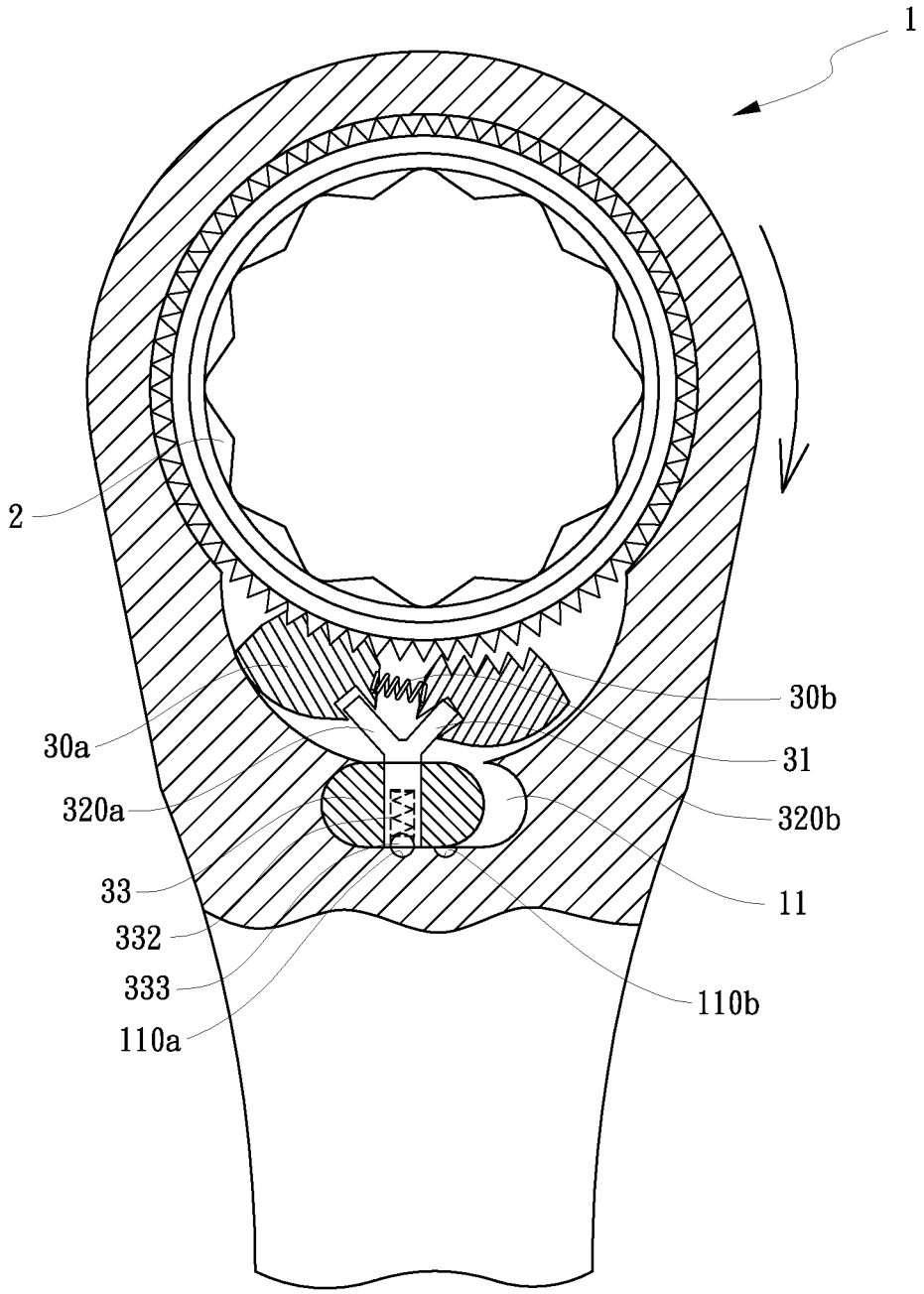
FIG. 4 is a front side view of the ratchet wrench, showing the ratchet wrench is ready to be operated clockwise.

The switch member 33 is formed as an ellipse corresponding to the switch room 11 of the wrench body 1. The switch member 33 is movable laterally to the left or right in the switch room 11. A vertical hole 331 is defined in the bottom of the switch member 33. A vertical spring 332 together with a ball 333 is received in the vertical hole 331 of the switch member 33 and rested on a bottom wall of the horizontal groove 110*a* or 110*b* of the wrench body 1. The ball 333 is able to be retracted into the vertical hole 331 so as to transversely slide upon the bottom wall of the switch room 11. Once the ball 333 is returned to a selected one of the horizontal grooves 110*a*, 100*b*, the ball 333 is positioned for example in the horizontal groove 110*a*, as shown in FIG. 4. A protrusion 334 is disposed in front of the switch member 33. A user can push laterally the protrusion 334 to drive the switch member 33 moving left and right in the switch room 11 of the wrench body 1, and therefore one of the pawls 30*a*, 30*b* is selectively engaged with the ratchet wheel 2.

Under this arrangement, once the switch member 33 is moved to the left (right), the left (right) pawl 30*a* (30*b*) is engaged with the ratchet wheel 2 and the right (left) pawl 30*b* (30*a*) is disengaged with the ratchet wheel 2, as shown in FIG. 4. At this time, rotation of the wrench body 1 in the direction, as indicated by the arrow in FIG. 4, drives the ratchet wheel 2 to rotate clockwise. However, if the wrench body 1 is rotated in the reverse direction, the pawl spring 31 is compressed and the pawls 30*a*, 30*b* are both released from the ratchet wheel 2. At this time, the ratchet wheel 2 is free rotating.

Referring to the FIG. 4, the switch member 33 is on the left side with the ball 333 positioned in the left horizontal groove 110*a* of the switch room 11, and the Y-shaped bar 32 is on the left side with its left prong 320 pushing the left pawl 30*a* to have the left pawl 30*a* engaged with the ratchet wheel 2 and the right pawl 30*b* disengaged with the ratchet wheel 2. However, if the wrench body 1 is rotated counterclockwise, the pawl spring 31 will be compressed and both the pawls 30*a*, 30*b* be disengaged from the ratchet wheel 2. In this respect, if the switch member 33 is on the left side, the ratchet wheel 2 is permitted to rotate clockwise with the wrench body 1 only.

Figure 5:
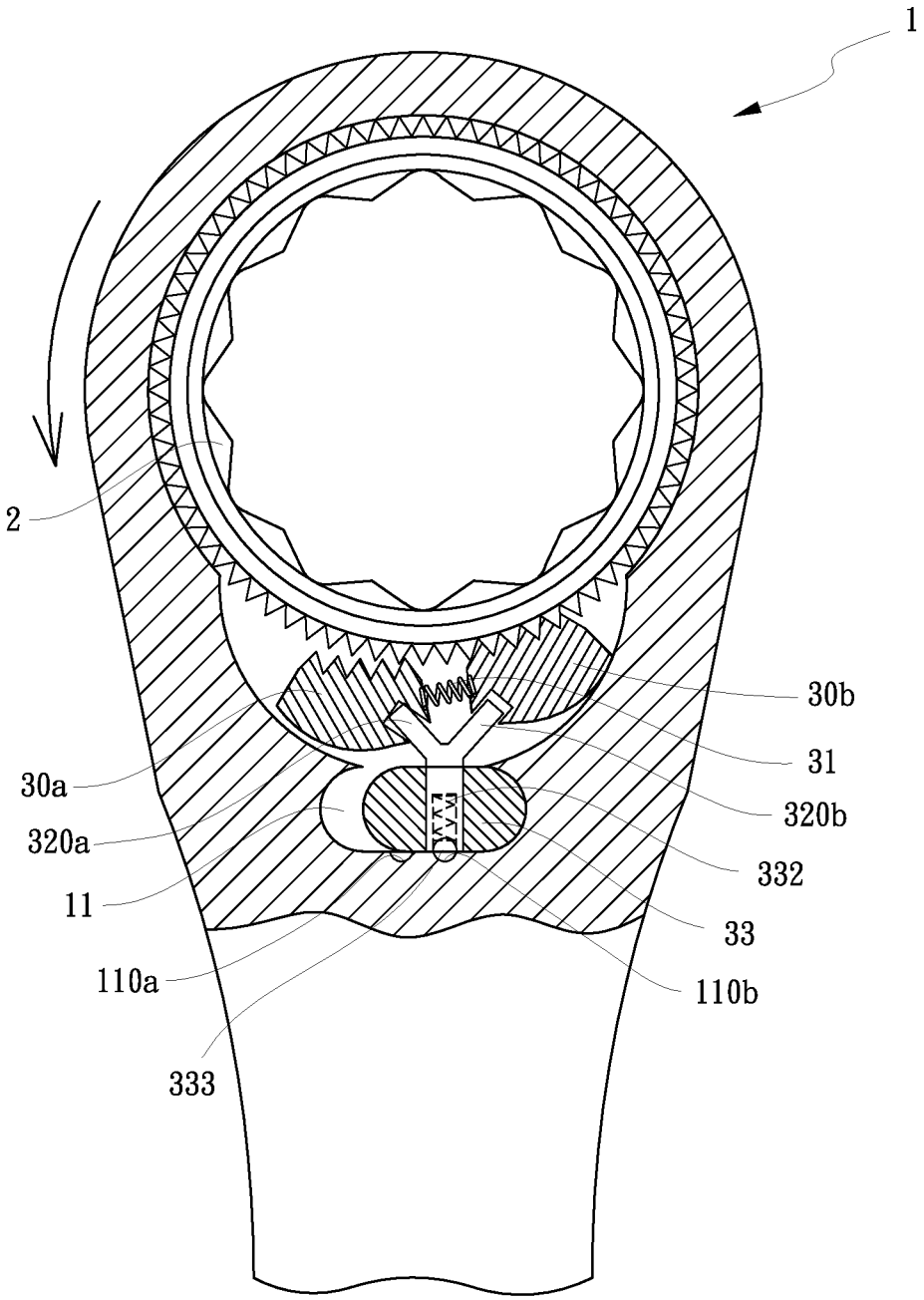
FIG. 5 is another front side view of the ratchet wrench, showing the ratchet wrench is ready to be operated counterclockwise.

On the contrary, referring to FIG. 5, the switch member 33 is moved to the right so that the ball 333 is positioned in the right horizontal groove 110*b* of the switch room 11, and the Y-shaped bar 32 is moved to the right with its right prong 320 pushing the right pawl 30*b* to have the right pawl 30*b* engaged with the ratchet wheel 2 and the left pawl 30*a* disengaged from the ratchet wheel 2. At this time, if the wrench body 1 is rotated clockwise, the pawl spring 31 is compressed and both the pawls 30*a*, 30*b* are released from the ratchet wheel 2. In other words, if the switch member 33 is on the right side, the ratchet wheel 2 is permitted to rotate counterclockwise only.

Although the invention has been explained in relation to its preferred embodiment, it is to be understood that many other possible modifications and variations can be made without departing from the spirit and scope of the invention as hereinafter claimed.

What is claimed is:

1. A ratchet wrench comprising a wrench body and a ratchet assembly disposed in the wrench body, wherein the ratchet assembly including:

a ratchet wheel;

a Y-shaped bar having a stem, a first prong and a second prong extending from the stem, the first prong tilted to the left, and the second prong tilted to the right;

a first pawl engageable with the ratchet wheel and defining a first bore in a lower right corner thereof, the first bore being tilted to the left for reception of the first prong of the Y-shaped bar, the first prong of the Y-shaped bar being not disengaged from the first bore during movement of the first pawl;

a second pawl engageable with the ratchet wheel and defining a second bore in a lower left corner thereof, the second bore being tilted to the right for reception of the second prong of the Y-shaped bar, the second prong of the Y-shaped bar being not disengaged from the second bore during movement of the second pawl;

a pawl spring disposed between the first and second pawls; and a switch member partly positioned on an exterior of the wrench body, the switch member having a positioning slot defined in a top thereof and the stem of the Y-shaped bar inserted into the positioning slot, the switch member being operable to drive the Y-shaped bar to move between a first position where the first pawl is moved to the left into engagement with the ratchet wheel by means of the first prong, and a second position where the second pawl is moved to the right into engagement with the ratchet wheel by means of the second prong.

2. A ratchet wrench as claimed in claim 1, wherein the first bore of the first pawl has a diameter each slightly greater than that of the first prong of the Y-shaped bar; and the second bore of the second pawl has a diameter each slightly greater than that of the second prong of the Y-shaped bar.

3. A ratchet wrench as claimed in claim 1, wherein the first pawl has a generally curved shape to correspond to a curvature of the ratchet wheel for engagement with a lower left side of the ratchet wheel; and the second pawl has a generally curved shape to correspond to the curvature of the ratchet wheel for engagement with a lower right side of the ratchet wheel.

* * * * *